US007005571B1

(12) United States Patent
Groff

(10) Patent No.: US 7,005,571 B1
(45) Date of Patent: Feb. 28, 2006

(54) MIDI CONTROLLER PEDALBOARD

(76) Inventor: Warren R. Groff, 1411 12th St., Los Osos, CA (US) 93402

( * ) Notice: Subject to any disclaimer, the term of this patent is extended or adjusted under 35 U.S.C. 154(b) by 0 days.

(21) Appl. No.: 10/269,387

(22) Filed: Oct. 11, 2002

Related U.S. Application Data

(63) Continuation-in-part of application No. 10/244,938, filed on Sep. 16, 2002, now abandoned.

(51) Int. Cl.
*G10H 7/00* (2006.01)

(52) U.S. Cl. ..... 84/645; 84/615; 84/619; 84/626; 84/653; 84/657

(58) Field of Classification Search ..... 84/600, 84/615–619, 626–627, 645, 653–658, 662–663, 84/721, 737, 742, 746
See application file for complete search history.

(56) References Cited

U.S. PATENT DOCUMENTS 5,565,641 A * 10/1996 Gruenbaum ..... 84/615
5,756,917 A * 5/1998 Watanabe et al. ..... 84/634
5,786,540 A * 7/1998 Westlund ..... 84/645
5,922,982 A * 7/1999 Ishibashi ..... 84/615

OTHER PUBLICATIONS

International Search Report. PCT/US03/29008. Apr. 22, 2004
American Musical Supply Catalog, Spring 2002, p. 152.
American Musical Supply Catalog, Summer 2002, p. 140.
Roland Users Group, Spring 1999, p. 43.
Roland PK-25 Pedal Keyboard Specifications, Fax from Roland Corporation U.S., May 26, 2000.
Roland PK-7 and PK-25 pedalboards, Fatar MP113 and MP117, American Musical Supply Spring 2002 Catalog.
Fatar Controller Keyboard, Studio-610 User Manual, 2002.

* cited by examiner

*Primary Examiner*—Marlon T. Fletcher
(74) *Attorney, Agent, or Firm*—Thomas F. Lebens; Sinssheimer, Schiebelhut & Baggett

(57) ABSTRACT

A MIDI controller pedalboard for composing and playing music such as pipe organ music is disclosed. The MIDI controller pedalboard provides pedals, and switches for the playing of notes and the manipulation of sound data in a MIDI format.

20 Claims, 9 Drawing Sheets

MIDI CONTROLLER PEDALBOARD

RELATED APPLICATION INFORMATION

This application is a continuation-in-part of U.S. application Ser. No. 10/244,938 filed Sep. 16, 2002, now abandoned, and entitled MIDI CONTROLLER PEDALBOARD.

BACKGROUND OF THE INVENTION

1. Field of the Invention

The present invention relates generally to MIDI devices, and more particularly to MIDI controllers.

2. Description of Related Art

Electronic musical instruments have become common in which sounds are produced by the playing of keys by a musician and stored as digital data on a recording medium. Such electrical instruments may be interfaced with other electrical devices such as synthesizers, controllers, and other instruments. A standard interface protocol used in the operation of electronic instruments and musical apparatuses, including synthesizers, keyboards, and controllers, is Musical Instrument Digital Interface (MIDI). Before discussing the aspects of MIDI, it is important to understand a few basic principles surrounding musical instruments. All musical instruments have the capability of making a variety of sounds by some means. Herein the action of starting a sound will be referred to as a "Note-On." Instruments generally also have some means of stopping the sound at a given time. This action will be referred to as "Note-Off." Most instruments also possess the ability to vary such sound components as volume and pitch. For example, the harder a pianist hits a particular key on the keyboard, the louder a given note sounds.

A MIDI device may contain three jacks for connection to other media including, a MIDI In, a MIDI Out, and a MIDI Thru. Each jack is a female 5-pin Deutsche Industrinorm (DIN) jack as standard on personal computers. When connecting two MIDI devices, the MIDI Out of one device connects to the MIDI In of the other device. To connect multiple devices together, each successive device has its MIDI In connected to the MIDI Thru of the previous device, this is referred to as daisy chaining. MIDI supports 16 channels through which information can be transmitted. Each individual device may be programmed to respond only when signals from a particular channel arrive. Should signals from other channels reach an attached device, it merely passes the signals on to the next device in the daisy chain. In this manner, a single controller can be used to operate a plurality of musical devices, and have separate control over each device.

In essence MIDI is a set of musical commands which are achieved through mulit-byte messages, each consisting of usually one status byte followed by one or two data bytes. These commands contain all of the information necessary to play a musical instrument such as "Note-On", "Note-Off", velocity, pitch, and aftertouch. The main advantages of MIDI are that it is easily edited, and is a compact form of data. MIDI "notes" and other musical actions, such as moving the pitch wheel or pressing the sustain pedal are separated by messages on different channels. This allows the musician to store the messages generated by many instruments in a single compact file, while retaining the ability for messages to be easily separated by instrument because the MIDI messages for each instrument are on a different MIDI channel.

Most MIDI controllers permit a high degree of control over the characteristics of the sound being produced. Such characteristics may include the MIDI channel number, the audio pan, the volume, the modulation, the aftertouch, etc. The term for this collection of settings is "patch." It is desirable for the controller or controllers used to have the ability to easily and readily change each patch setting, without inhibiting the playing of the instruments and/or synthesizers being controlled.

SUMMARY

The present invention may provide an improved circuitry for controlling MIDI signals for output to a plurality of MIDI devices, and may have particular relevance to musicians in the composing and playing of pipe organ music and other music forms where a third score is desired. The present invention accomplishes these means by providing a plurality of easily accessible swell shoes/volume pedals, sustain pedal, switches, a dial, and note pedals, for the manipulation of MIDI signals and advancement of such MIDI signals to attached MIDI devices. The MIDI controller pedalboard is designed in a manner that is feature packed and still performance friendly.

To achieve these and other advantages in accordance with the present invention, as embodied and broadly described herein, the invention provides a MIDI controller pedalboard comprising a plurality of note pedals, a transpose function and transpose function circuitry, a plurality of bank switches, a volume controller circuitry, and a first MIDI output jack. The plurality of note pedals may comprise 32 note pedals, which may be disposed in a concave radiating configuration, and the plurality of bank switches may comprise a 16' bank switch, an 8' bank switch, and a 4' bank switch. The plurality of note pedals may be velocity sensitive.

The volume controller may comprise a volume control pedal and a minimum volume dial. The volume control pedal may be electrically disconnected from the MIDI controller pedalboard and electrically connected to a separate MIDI device.

The MIDI controller pedalboard may further comprise a velocity curve modification function and velocity curve modification function circuitry, a program selection function and program selection function circuitry, a MIDI channel selection function and MIDI channel selection function circuitry, and a control shoe function selection and control shoe function selection circuitry. The transpose function circuitry comprises a transpose switch and related circuitry that may be used in conjunction with the 32 note pedals. The velocity curve modification function circuitry may comprise a velocity curve modification switch and related circuitry. The program selection function comprises a program selection switch that may be used in conjunction with the 32 note pedals, and the MIDI channel selection function circuitry comprises a MIDI channel selection switch and related circuitry that may be used in conjunction with the 32 note pedals.

The control shoe function selection circuitry comprises a control shoe function selection switch and related circuitry and a control swell shoe pedal that may be operated in conjunction with the 32 note pedals. The control shoe function selection may comprise and may be switched between an aftertouch function, a pitch bend function, a modulation function, a volume function, and a left to right audio panning function. The default function may comprise the modulation function.

The MIDI controller pedalboard may further comprise a pitch bend swell shoe pedal and a removable sustain pedal, and the removable sustain pedal may be attached to the MIDI controller pedalboard by hook and loop material such as velcro. The pitch bend swell shoe pedal may be a spring-loaded shoe that returns to a center position.

The first output jack of the MIDI controller pedal board may transmit a default velocity curve. The MIDI controller pedalboard may further comprise a second MIDI output jack and a removable programmable velocity converter. The second MIDI output jack may transmit a programmed velocity curve based on the removable velocity converter.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DETAILED DESCRIPTION OF THE PREFERRED EMBODIMENTS

Figure 1:
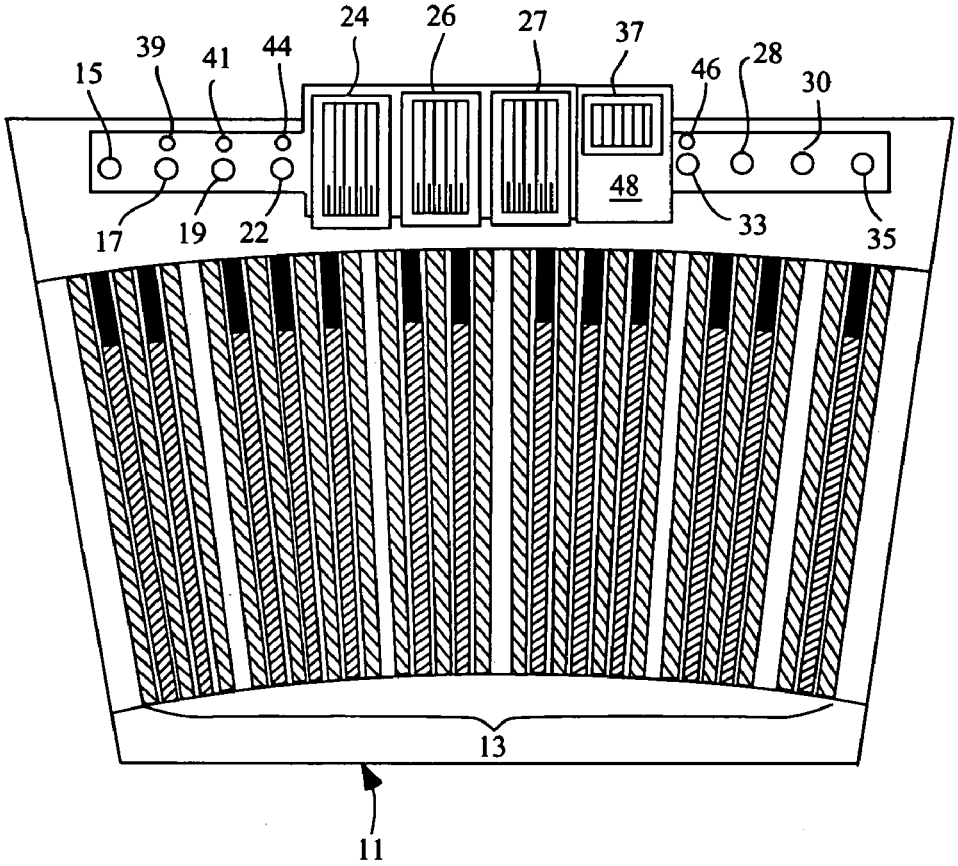
FIG. 1 is a plan view of the preferred embodiment of the MIDI controller pedalboard.

Reference will now be made in detail to the presently preferred embodiments of the invention, examples of which are illustrated in the accompanying drawings. Wherever possible, the same or similar reference numbers are used in the drawings and the description to refer to the same or like parts. It should be noted that the drawings are in greatly simplified form and are not to precise scale. In reference to the disclosure herein, for purposes of convenience and clarity only, directional terms, such as, top, bottom, left, right, up, down, above, below, beneath, rear, and front, are used with respect to the accompanying drawings. Such directional terms should not be construed to limit the scope of the invention in any manner.

Although the disclosure herein refers to certain illustrated embodiments, it is to be understood that these embodiments are presented by way of example and not by way of limitation. The intent of the following detailed description is to cover all modifications, alternatives, and equivalents as may fall within the spirit and scope of the invention as defined by the appended claims. For example, it is understood by a person of ordinary skill in the art that the pedalboard controller would work equally well on any MIDI-fitted instrument such as an electric keyboard, or a piano that has been retrofitted with a MIDI OUT, a MIDI IN, and a mechanical means of depressing the piano keys.

It is to be understood and appreciated that the elements and structures described herein do not cover a complete process flow for the manufacture of MIDI controllers or pedalboards. The present invention may be used in conjunction with various other MIDI devices, including synthesizers, tone modules, other controllers, a plurality of instruments, and personal computers.

The present invention employs numerous quad digital or analog bilateral switches (RCA 4066 integrated circuits). The RCA 4066 contains four electronic switches, each with a terminal responsible for opening or closing its corresponding switch. Herein each individual electronic switch within the RCA 4066 will be referred to as a "bilateral switch" and its respective terminal, which is responsible for opening or closing the switch, will be referred to as its "control voltage terminal." Each bilateral switch may be an independent normally open switch or a normally closed switch, depending on the biasing of the control voltage terminal. For example, if the control voltage terminal is biased from positive through an appropriate resistor, the switch will normally be closed. When a ground is introduced to the control voltage terminal, the switch will open. If the control voltage terminal is biased from ground through an appropriate resistor, the switch will be normally open. When a positive voltage is introduced to the control voltage terminal, the switch will close.

Referring more particularly to the drawings, FIG. 1 illustrates a perspective view of the MIDI controller pedalboard 11 embodied in the present invention. The MIDI controller pedalboard 11 comprises a plurality of note pedals, switches, and swell shoe pedals for the precise control of musical data. The pedalboard may be laid out in a 32 note concave radiating configuration whose dimensions may equal those approved by the American Guild of Organists (AGO). The 32 note pedals 13 may be either velocity sensitive or not velocity sensitive. Other possible configurations include a "concave-convex" setup or a flat pedal setup as standard in older European Organs.

The pedalboard comprises, in addition to the 32 note pedals 13, a transpose switch 15, a 16' bank switch 17, an 8' bank switch 19, and a 4' bank switch 22, a full-time pitch bend swell shoe pedal 24, an assignable control swell shoe pedal 26, a volume swell shoe pedal 27, a program switch 28, a channel switch 30, a velocity switch 33, a control switch 35, 2 MIDI output jacks (not shown), and optionally a removable sustain pedal 37 or a removable volume swell shoe pedal (not shown). The 32 note pedals 13 represent keys in the Western chromatic scale, which is referred to as C, C#, D, D#, E, F, F#, G, G#, A, A#, and B. FIG. 1 depicts the pedalboard having 32 note pedals 13, the first pedal representing the first C, and the thirty-second pedal representing the last G. For the sake of brevity, only those pedals which are needed to perform particular functions with relation to aspects of the present invention will be assigned reference numbers. A plurality of LED's also exist, comprising a 16' bank switch LED 39, an 8' bank switch LED 41, a 4' bank switch LED 44, and a velocity switch LED 46.

In the illustrated embodiment an optional sustain pedal 37, which may be removably attached, is connected to the MIDI controller pedalboard 11 by means of a hook and loop material 48 such as velcro. In alternative embodiments, the optional sustain pedal 37 may be removably attached such as by means of a magnet, or it may lock into place via a locking mechanism.

The sustain pedal, when depressed, causes the notes currently being played and all subsequent notes played to continue to sound even after the note pedals or keys are no longer depressed. To halt the continuance of the notes being sustained, it is necessary to release the sustain pedal, at which time the MIDI sustain off command is sent.

The 16' bank switch 17, 8' bank switch 19, and 4' bank switch 22 involve circuitry that works in conjunction with the note pedals and the motherboard. By turning on one or more of the 16', 8' or 4' bank switches, the pedalboard will play in specific 32 note ranges that are an octave (a musical interval embracing eight diatonic degrees) apart. The 16' bank switch 17, 8' bank switch 19, and 4' bank switch 22 have light emitting diodes (LEDs) over them to indicate for each individual switch whether or not it is activated. These bank switches may be used in any combination, allowing a single pedal to play as many as three notes simultaneously, each an octave apart (much like the inter-manual couplers on a pipe organ that couple ranks of pipes of a manual to the pedals). The bank switches also may be turned on or off while a pedal is depressed without creating a MIDI glitch. A note on message will be sent when a pedal is being held down and a bank switch is turned on, while a note off message will be sent when a pedal is being held down if a bank switch is turned off. This prevents the occurrence of hanging notes that continue to play long after they were sounded due to the synthesizer never having received a note off command.

Figure 2:
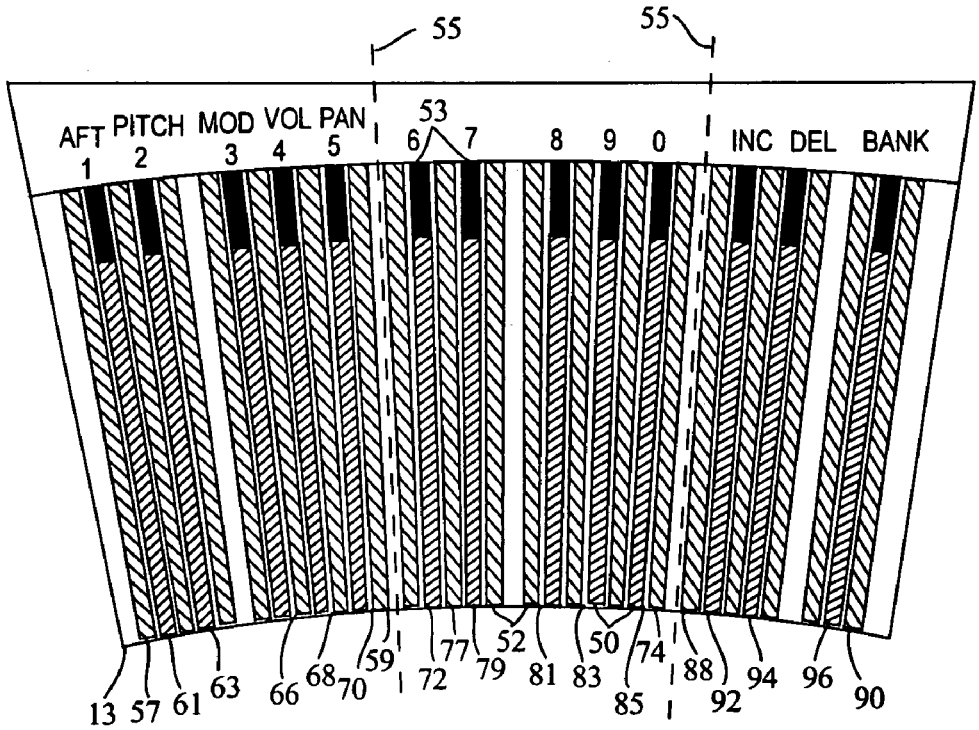
FIG. 2 is a zoomed in plan view of the 32 note pedals.

Referring to FIG. 2, a zoomed in view of the 32 note pedals 13 is detailed. The 32 note pedals 13 are divided into 13 sharp note pedals 50 and 19 natural note pedals 52. Each of the 13 sharp note pedals 50 may include a pedal block 53. The 32 note pedals 13 comprise two whole octaves and one partial octave, the octaves being divided in the illustration by dividing lines 55 (shown in phantom). The first octave comprises pedals representing seven natural notes from a first C 57 through a first B 59, and a first C# 61, a first D# 63, a first F# 66, a first G# 68, and a first A# 70. The second octave comprises pedals representing seven natural notes from a second C 72 through a second B 74, and a second C# 77, a second D# 79, a second F# 81, a second G# 83 and a second A# 85. The third octave (partial octave) contains pedals representing five natural notes from a third C 88 through a third G 90, and a third C# 92, a third D# 94, and a third F# 96.

Figure 3:
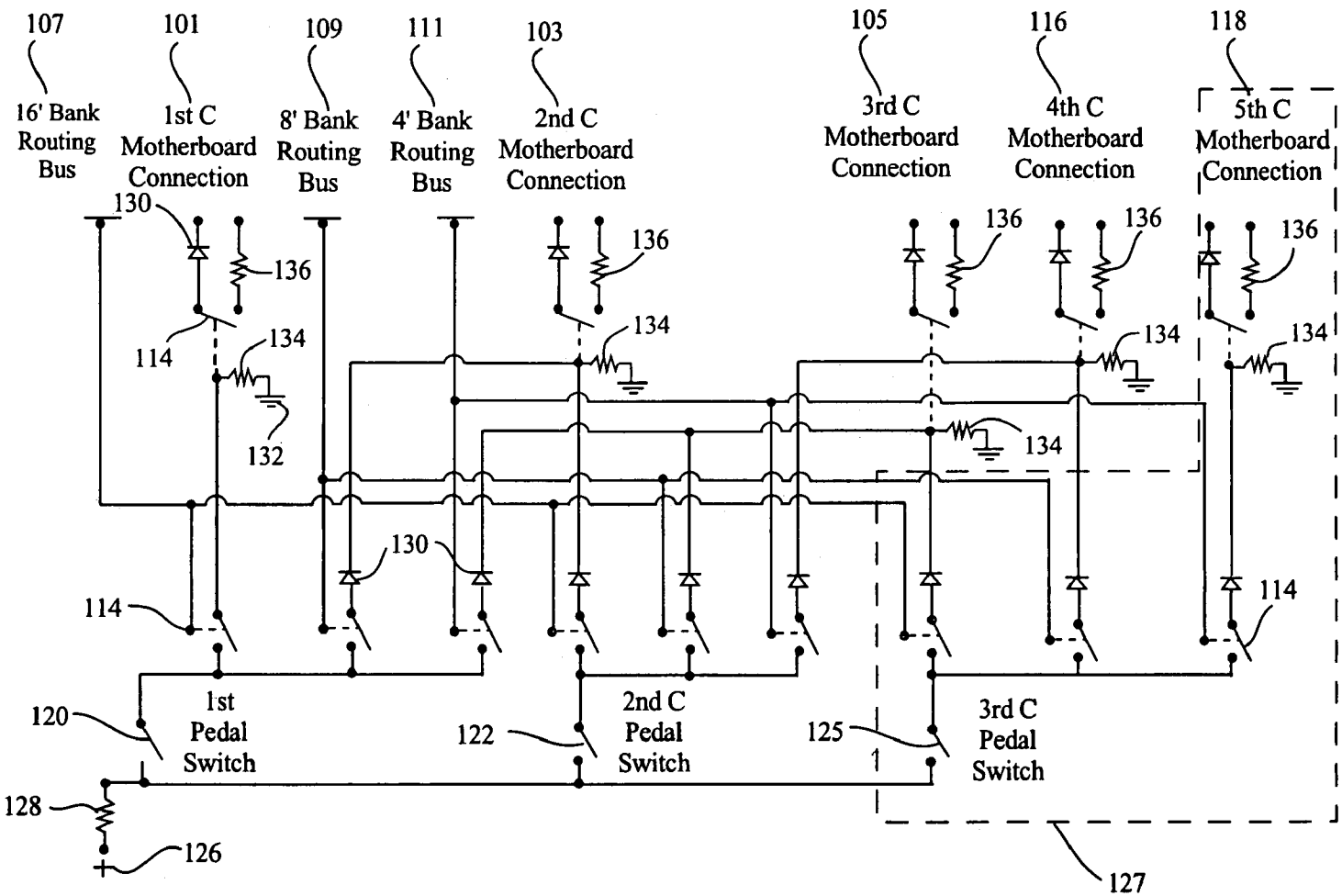
FIG. 3 is a circuit diagram illustrating the wiring of the note pedals to a motherboard.

In FIG. 3 the wiring for the first C 57, second C 72, and third C 88 are shown. Wherein only one first C pedal switch 120, one second C pedal switch 122, and one third C pedal switch 125 are shown in FIG. 3, the first C note pedal 57, second C note pedal 72, and third C note pedal 88 activate two identical switches. Each note pedal on the pedalboard employs two switches to enable the notes to be velocity sensitive. Because the circuitry is duplicated and identical for each of the two note pedal switches, further discussion will involve the circuitry for just one of the pedal switches. When the first C 57 note pedal is depressed, a corresponding first C pedal switch 120 is closed, and information travels to a first C motherboard connection 101 if the 16' bank switch 17 is activated, to a second C motherboard connection 103 if the 8' bank switch 19 is activated, and to a third C motherboard connection 105 if the 4' bank switch 22 is activated. When the 16' bank switch 17, 8' bank switch 19, or 4' bank switch 22 is activated, then a 16' bank routing bus 107, 8' bank routing bus 109, or 4' bank routing bus 111 allows an appropriate bilateral switch 114 to be closed respectively. The closing of the appropriate bilateral switch 114 permits the note on signal to be advanced to the respective first C motherboard connection 101, second C motherboard connection 103, or third C motherboard connection 105. When the second C 72 is played, a similar process occurs, in which the 16' bank routing bus 107, 8' bank routing bus 109, and 4' bank routing bus 111 allow a note on signal to be advanced to the MIDI controller pedalboard 11 through a second C motherboard connection 103, third C motherboard connection 105, or fourth C motherboard connection 116 respectively. Likewise, the third C 88 permits a note on signal to be sent to a third C motherboard connection 105, a fourth C motherboard connection 116, or a fifth C motherboard connection 118.

Each note, from the first C 57 through the third G 90 contains substantially similar wiring. For example, the first C pedal switch 120, second C pedal switch 122, and third C pedal switch 125 of FIG. 3 may be replaced by a first D# pedal switch, second D# pedal switch, and third D# pedal switch respectively to obtain the wiring for the D# notes. Note pedals G# through B lack the fifth motherboard connection wiring (shown in phantom) due to the fact that there are for example only a first G# and a second G# on the pedalboard.

In the presently preferred embodiments, one end of each pedal switch (eg. first C pedal switch 120) is connected to a positive voltage 126 through a 400 ohm resistor 128. The other end of each pedal switch is connected to three examples of an RCA 4066 bilateral switch 114. The control voltage terminal that opens or closes the RCA 4066 bilateral switches 114 is connected to a routing bus (eg. 16' bank routing bus 107) and the other terminal of these RCA 4066 bilateral switches connects to the control voltage terminal of the motherboard connection bilateral switch (eg first C motherboard connection 101) and a 100K ohm resistor 134 that is connected to ground. Each motherboard connection (eg. first C motherboard connection 101) comprises a RCA 4066 bilateral switch 114 connected in series with a diode 130 and a 50 ohm resistor 136.

In the presently preferred embodiments, the motherboard for this MIDI controller pedalboard comes from a "Fatar Studio 610 controller keyboard." The circuitry of the MIDI controller pedalboard is designed to interact with this motherboard to be able to play octaves on the pedalboard, be velocity sensitive or not velocity sensitive, and have its functions be available from a 32 note pedalboard controller, and not the standard 61 note keyboard controller. The MIDI controller pedalboard may however be constructed using other controller motherboards.

FIGS. 4*a* through 4*d* illustrate a side view of a note pedal 129 of the 32 note pedals 13 in various stages of being depressed. Each note pedal 129 may be designed with a plurality of electrical switches, which may comprise a first electrical switch 131 and a second electrical switch 133 such that the first electrical switch 131 can close before the second electrical switch 133, thus enabling the note pedal 129 to be velocity sensitive. Referring back to FIG. 3, in the case of the first C 57 note pedal for example, the first electrical switch 131 would correspond to the first C pedal switch 120. Each note pedal 129 may further comprise a plurality of springed rods, which may comprise a first springed rod 135 and a second springed rod 137 for impelling the first electrical switch 131 and the second electrical switch 133 closed respectively. In the illustrated embodiment, each "springed rod" comprises a spring loaded capstan head machine screw made from delrin (which material is similar to nylon only slightly harder). To minimize the noise that the springed rod generates when the pedal is released, a noise dampener 138 such as a felt washer may be employed. In the presently preferred embodiment, the noise dampener 138 is installed over/around the springed rod 135 and retained by a lock nut 140. The note pedal 129 may also further comprise an upper pad 139 and a lower pad 141, which together may define the range of motion permitted the note pedal 129. The note pedal 129 may be attached to a housing unit 144 with a piece of flat spring stock 146. Spring tension may be increased or decreased by tightening or loosening a mounting screw 145.

Figure 4A:
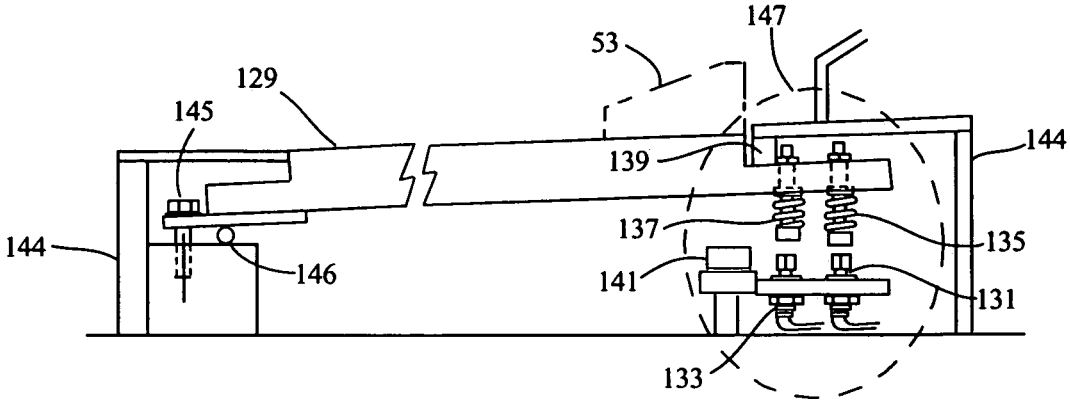
FIG. 4*a* is a side view of a note pedal in a resting position.
Figure 4B:
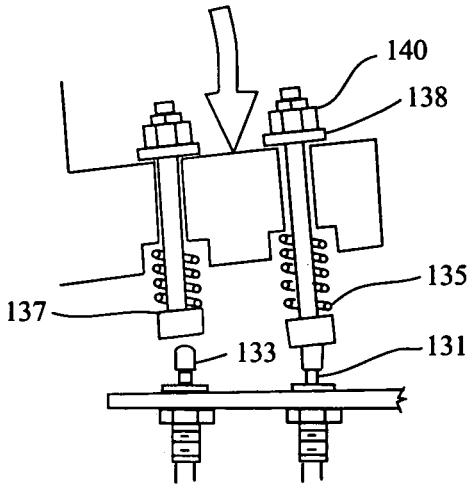
FIG. 4*b* depicts the side view of FIG. 4*a*, after the pedal has become slightly depressed.
Figure 4C:
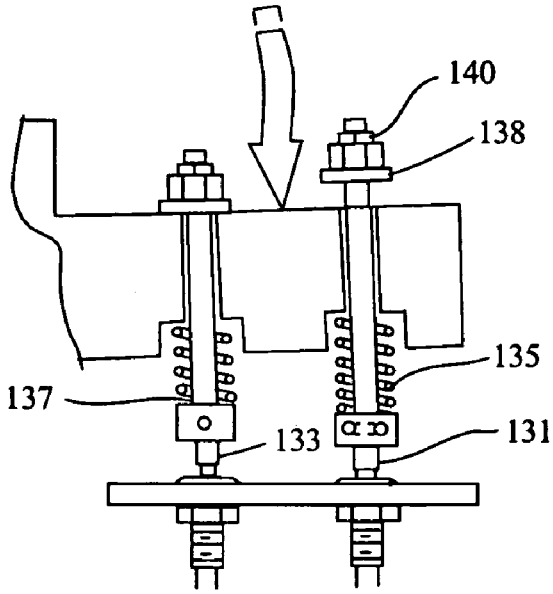
FIG. 4*c* depicts the side view of FIG. 4*b*, after the note pedal has become further depressed.

The time elapsed between closing the first electrical switch 131 and the second electrical switch 133 determines the MIDI velocity number (how hard the note is played) assigned to the note being played. FIG. 4*a* shows a note pedal 129 in a resting position. At the head of the note pedal 129 a pedal block 53 is shown in phantom. Pedal blocks 53 are only disposed above the 13 sharp note pedals 50. The area outlined by an oval 147 (shown in phantom) in FIG. 4*a* is shown in different stages of being depressed in FIGS. 4*b* through 4*d*. FIG. 4*b* shows the area outlined by the oval 147 of the same note pedal 129 of FIG. 4*a* in an intermediate stage of being depressed in which the first electrical switch 131 is in contact with a first springed rod 135, but is still open. FIG. 4*c* depicts the note pedal 129 of FIG. 4*b*, in which the note pedal 129 has been further depressed, and the first electrical switch 131 is closed, and a second springed rod 137 is in contact with the second electrical switch 133, but the second electrical switch 133 is still open.

Figure 4D:
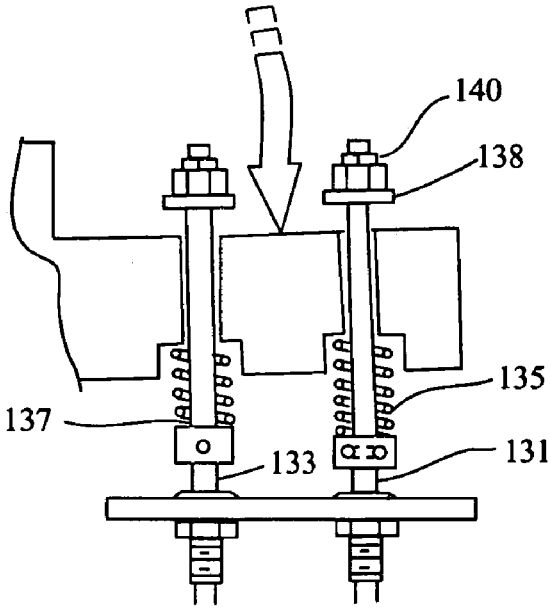
FIG. 4*d* depicts the side view of FIG. 4*c*, after the note pedal has become fully depressed.

FIG. 4*d* illustrates the note pedal 129 of FIG. 3*c* after the note pedal 129 has become completely depressed, and both the first electrical switch 131 and the second electrical switch 133 are closed. This arrangement allows an accurate method for regulating the distance/time between the two switches being closed.

The transpose switch 15 can transpose the pedalboard pitch (change from one key to another, eg. C to D) by half step intervals (a musical interval equivalent to one twelfth of an octave) by up to two octaves below its initial default range, or in half step intervals by as much as a fifth above its initial default range. The transpose function is accomplished by holding down the transpose switch 15 while playing a note above or below the third C 88 (reference note) that represents the pitch interval up or down to be transposed. When the note is released and the transpose switch 15 is released the pedalboard pitch will be transposed.

For example, if it were desired to transpose the range down an octave, one would hold the transpose switch 15 down and play the second C 72 (an octave below the reference note) on the pedalboard, release the pedal and transpose switch 15 and the pedalboard pitch would be transposed down an octave. If it were desired to transpose the range up a fifth, one would hold the transpose switch 15 down and play the third G 90, release the pedal and transpose switch 15 and the pedalboard pitch would be transposed up a fifth.

Figure 5:
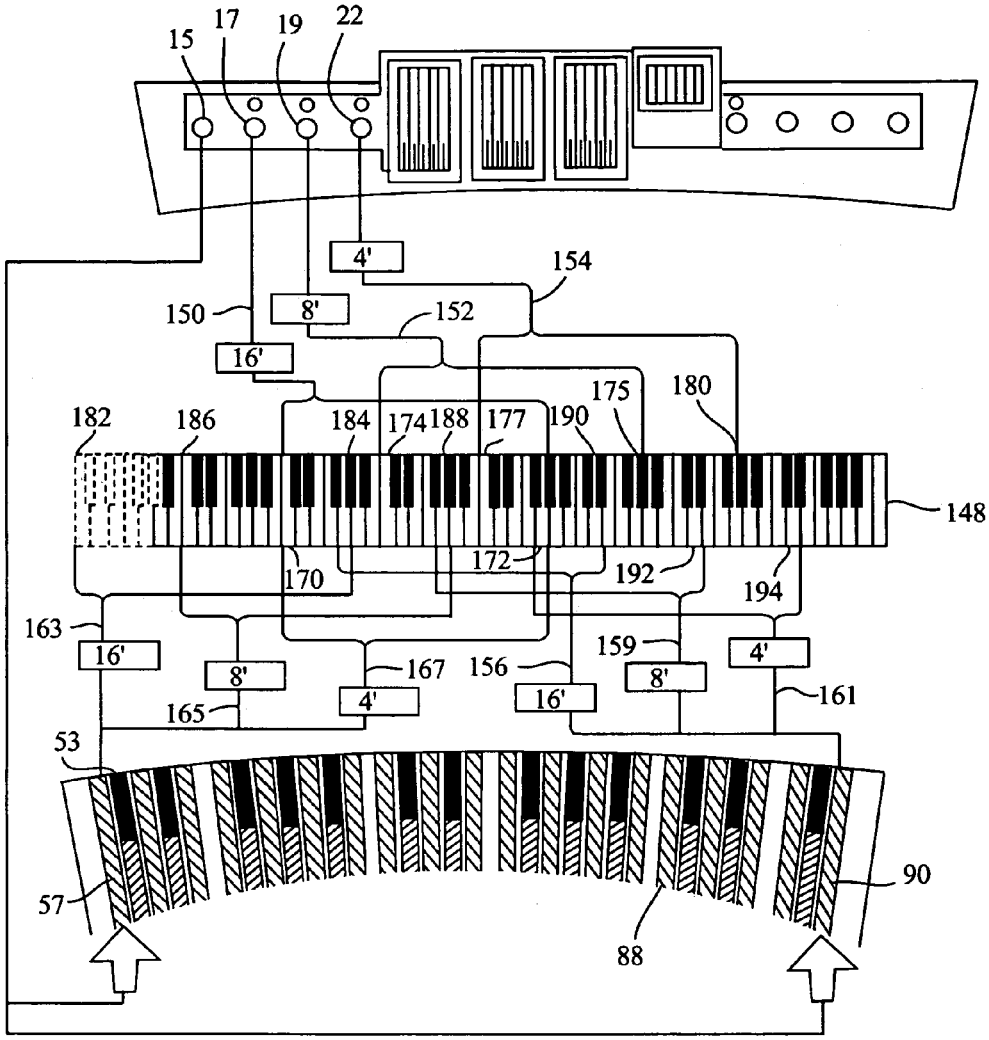
FIG. 5 is a plan view exemplifying the default ranges and examples of the transposed ranges of the 16', 8', and 4' banks.

FIG. 5 is a plan view exemplifying on a standard piano keyboard 148: the 16' bank default range 150, the 8' bank default range 152, and the 4' bank default range 154. The 16' range after being transposed up a $5^{th}$ 156 and down two octaves 163, the 8' range after being transposed up a $5^{th}$ 159 and down two octaves 165, and the 4' range after being transposed up a $5^{th}$ 161 and down two octaves 167 are also illustrated. The default range for the 16', 8' and 4' banks are C1 170 to G3 172, C2 174 to G4 175, and C3 177 to G5 180 respectively.

After being transposed down two octaves (by holding down the transpose button and playing first C 57 on the pedalboard), the 16' bank switch 17 allows the pedalboard to play notes C-1 182 through G1 184, the 8' bank switch 19 allows the pedalboard to play notes C0 186 through G2 188, and the 4' bank switch 22 allows the pedalboard to play notes C1 170 through G3 172. Should the pedalboard be transposed up a $5^{th}$ (by holding down the transpose button and playing the third G 90 on the pedalboard), then the 16' bank switch 17 allows the pedalboard to play notes G1 184 through D4 190, the 8' bank switch 19 allows the pedalboard to play notes G2 188 through D5 192, and the 4' bank switch 22 allows the pedalboard to play notes G3 172 through D6 194. Note that the 16', 8', and 4' bank switches are each always separated by an octave.

The pedalboard has a spring-loaded full-time pitch bend swell shoe pedal 24 that returns to the center position. The pitch bend swell shoe pedal allows the user to change the frequency at which a particular note being played vibrates. For example an A vibrates at 440 hz, so using the pitch bend while an A is being played would allow the musician to increase that frequency above 440 hz, or reduce it below 440 hz. The center position return enables the pedal to be raised or lowered by foot manipulation, allowing a single pedal to be able to perform for example both a pitch up and a pitch down command. Many modern MIDI keyboards include a pitch bend wheel that performs substantially the same function. It is however difficult for musicians to smoothly perform pitch changes with these instruments due to the nature of the pitch bend wheel, which must be manipulated by hand. The pedalboard allows the musicians hands to remain free to continue playing notes while his feet perform the pitch bend.

The assignable control swell shoe pedal 26 may be assigned to aftertouch, pitch bend, modulation, volume, or left to right audio panning. This assignment is accomplished by holding down the control switch 35 and then playing one of the lowest five sharps, releasing the note and then releasing the control switch. Referring back to FIG. 2, the first C# 61 assigns the assignable control swell shoe pedal 26 to aftertouch, the first D# 63 assigns it to pitch bend, the first F# 66 assigns it to modulation, the first G# 68 assigns it to volume, and the first A# 70 assigns it to audio panning. Each respective note pedal may be appropriately labeled above the pedal as shown in FIG. 2.

The default setting for the control swell shoe pedal 26 is modulation control. Aftertouch is the effect obtained on keyboards by adding pressure to a key after it has already been fully depressed with a lighter pressure. Aftertouch usually adds modulation to a tone, however it may be assigned to different functions (such as volume, a different envelope filter, etc.) within a particular keyboard. Rather than having to control this aspect by having ones feet play a note harder after it has been depressed, it can be accomplished when the control swell shoe pedal 26 is assigned to control the aftertouch function. Assigning the control swell shoe pedal 26 to control pitch bend allows the user to bend the pitch and leave it at a particular raised or lowered pitch level without the swell shoe, and thus pitch, returning to an initial position. Assigning the control swell shoe pedal 26 to control modulation would control modulation, a tremolo type of effect. Assigning the control swell shoe pedal 26 to control volume allows it to control the volume of the device being controlled via MIDI. This permits the full-time volume pedal to independently control the volume of a second device. Assigning the control swell shoe pedal 26 to control the audio panning enables the musician to designate the relative volumes of the left audio output and right audio output.

Beside the assignable control swell shoe pedal 26, the MIDI controller pedalboard 11 has a full-time volume swell shoe pedal 27 which may also comprise a minimum volume setting knob or dial (not shown). This volume control swell shoe pedal 26 may be used in conjunction with the MIDI output of the pedalboard, or may be plugged into a keyboard or tone module. A removable volume swell shoe pedal may be used in place of the removable sustain pedal 37. The removable volume swell shoe pedal may be used in conjunction with the MIDI output of the MIDI controller pedalboard 11, or may be electrically connected to another MIDI device to control its volume separately.

The program/patch number message may be sent by holding down the program switch 28, playing one or more of the first C# 61, first D# 63, first F# 66, first G# 68, first A# 85, second C# 77, second D# 79, second F# 81, second G# 83, or second A# 85, which may be labeled 1 through 9 and 0 respectively (see FIG. 2), releasing the note or notes and then releasing the program switch 28. For example, patch number 3 would be obtained by holding down the program switch 28, depressing and releasing the first F# 66 (labeled 3 above it), and releasing the program switch 28. To obtain patch number 123, one would hold down the program switch 28, depress and release in order, the first C# 61 (labeled 1), the first D# 63 (labeled 2), and the first F# 66 (labeled 3), then release the program switch. As standard in MIDI devices, 128 program patches are available. The patch number may also be incremented or decremented by holding down the program switch 28, depressing and releasing the third C# 92 (labeled INC) or third D# 94 (labeled DEC) respectively and releasing the program switch 28.

The bank number may be changed in a similar fashion. Like the program patches, 128 bank numbers are possible (0 to 127 or 1 to 128). To obtain a bank change, one would hold down the program switch 28 depress and release the third F# 96 (labeled BANK), depress and release the appropriate numbered sharp or the INC or DEC sharp, then release the program switch 28. In the MIDI protocol, the MIDI program change message is hardwired to have a limit of only 128 possible selections. In order to have more than 128 patches, a program bank must be used. Patches are arranged in banks of 128 patches each. Patch numbering is an aspect of MIDI that is not completely standardized from one manufacturer to another. Some manufacturers number their patches from 1 to 128 while others number their patches from 0 to 127. For example, "bank 1" includes 128 patches that would be numbered from 1 to 128 or from 0 to 127, "bank 2" has 128 different patches that would be numbered from 1 to 128 or 0 to 127, etc. The maximum possible number of patches available to a MIDI device is 16,384. In order to select a desired patch, the musician must first select the desired bank or currently be in that particular bank, and then select the desired patch within that bank.

The channel switch 30 operates along similar guidelines to the program switch 28. Like the program number, the channel number can be changed by holding down the channel switch 30, depressing and releasing the appropriate numbered sharp (first C# 61 through second A# 85) or the third C# 92 (labeled INC) or third D# (labeled DEC), then releasing the channel switch 30. As standard in MIDI devices, the MIDI controller pedalboard 11 may select any channel from channels 1 through 16.

Figure 6:
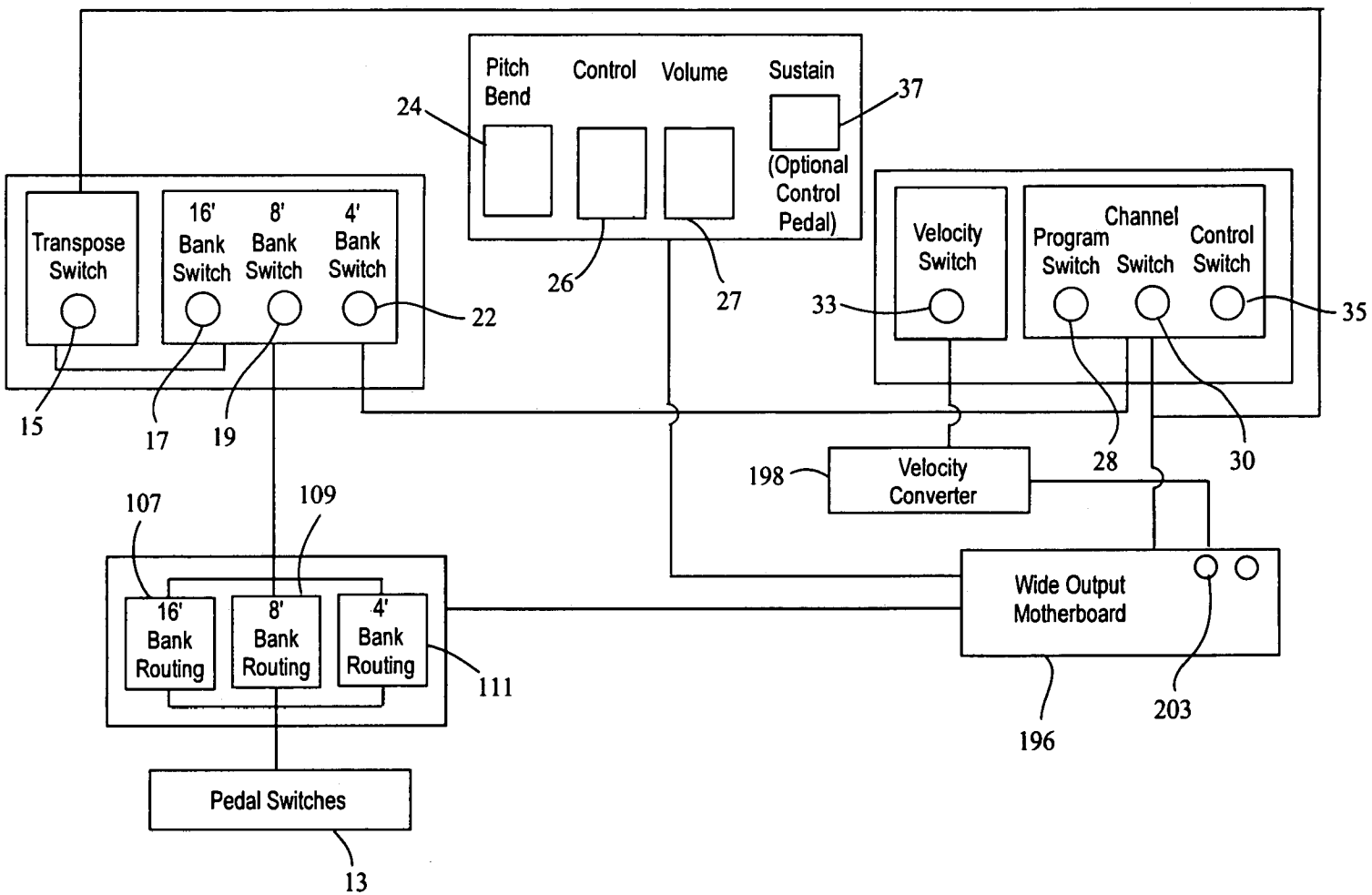
FIG. 6 is a block diagram illustrating electrical connection between elements of the MIDI controller pedalboard.

FIG. 6 depicts a block diagram showing electrical connections between elements of the MIDI controller pedalboard 11. The pedal switch connections are advanced to the motherboard connections via the 16' bank routing circuit 107, 8' bank routing circuit 109, and/or the 4' bank routing circuit 111 depending on whether or not the 16' bank switch 17, 8' bank switch 19, and/or 4' bank switch 22 are activated. Pitch bend, control swell shoe functions, volume, and sustain messages are also sent, respectively, by the pitch bend swell shoe pedal 24, assignable control swell shoe pedal 26, volume swell shoe pedal 27, and the sustain pedal 37 to the MIDI output motherboard 196. The transpose, program, channel, and control functions work in conjunction with the transpose switch 15, program switch 28, channel switch 30, and control switch 35, respectively, and with the electronic bank selection circuits, bank routing, and pedal notes to produce the corresponding MIDI message at the motherboard 196. If the velocity switch 33 is activated, then the MIDI information stream is sent from the motherboard 196, through a MIDI velocity converter 198 where the velocity portion of the messages are modified, and back to the switched MIDI output jack on the motherboard 196. The MIDI output motherboard 196 receives all of the incoming note switching and other functional input and outputs the MIDI message accordingly.

The present invention has two MIDI output jacks, comprising a first MIDI output jack 201, and a second MIDI output jack 203. The first MIDI output jack 201 is a full-time output for the default velocity curve, while the second MIDI output jack 203 may send the default velocity curve, or if the velocity switch 33 is enabled (it has a velocity switch LED 46 to indicate that it is activated) the MIDI information stream is routed through the MIDI velocity converter 198 and back to the switched output jack. The MIDI velocity converter 198 may be attached to the back of the MIDI controller pedalboard 11 by an adhesive such as hook and loop material (Velcro) or other such adhesive methods, and an electrical connector so that it may be removed and taken to a computer for programming. The converter may be programmed for different velocity output curves, including a constant output number or other variable curves on each of the 16 MIDI channels. An example of how it may be programmed would be for it to send a fairly high fixed level output velocity number (in the 90's on a MIDI scale of 0 to 127) on channels 1 and 2 and a medium fixed level velocity number on channels 3 and 4, and a lower velocity number on channels 5 and 6. This would allow the user to access different fixed velocity output levels by changing MIDI channels.

Figure 7:
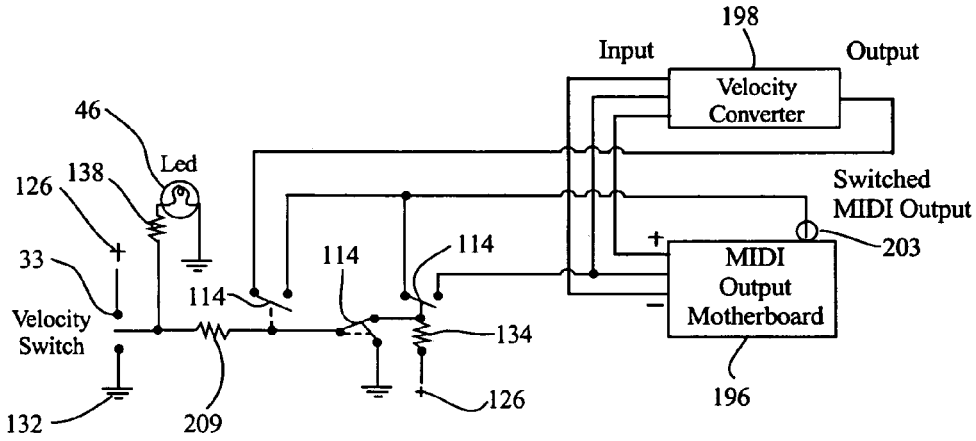
FIG. 7 is a circuit diagram depicting the velocity switch circuitry, velocity converter, and MIDI output of the motherboard.

FIG. 7 illustrates a circuit diagram corresponding to a presently preferred embodiment, depicting the velocity switch 33 connected to the MIDI velocity converter 198 and the MIDI output motherboard 196. Since one wire contains the MIDI information stream, it is necessary to switch between the default MIDI information stream wire and the velocity converted information stream wire. The velocity switch 33 is a single pole, double throw switch that switches between ground 132 and positive 126. When the velocity switch 33 is switched to negative, there is no current path through the 680 ohm resistor 138 or the velocity switch LED 46 and the LED does not light. The first two RCA bilateral switches 114 are open and the third is closed, allowing the default velocity curve MIDI stream from the motherboard 196 to be sent to the switched MIDI output jack 203 of the motherboard 196.

When the velocity switch 33 is switched to positive, current flows through a 680 ohm resistor 138 and through the velocity switch LED 46 to ground, thus lighting the velocity switch LED 46 to indicate that the velocity converter is being employed. The first two RCA 4066 bilateral switches 114 close, and the third RCA 4066 bilateral switch 114 opens as the control voltage terminal is now connected to ground. This allows the converted velocity MIDI stream to be connected to the switched MIDI output jack 203 of the motherboard 196.

Figure 8:
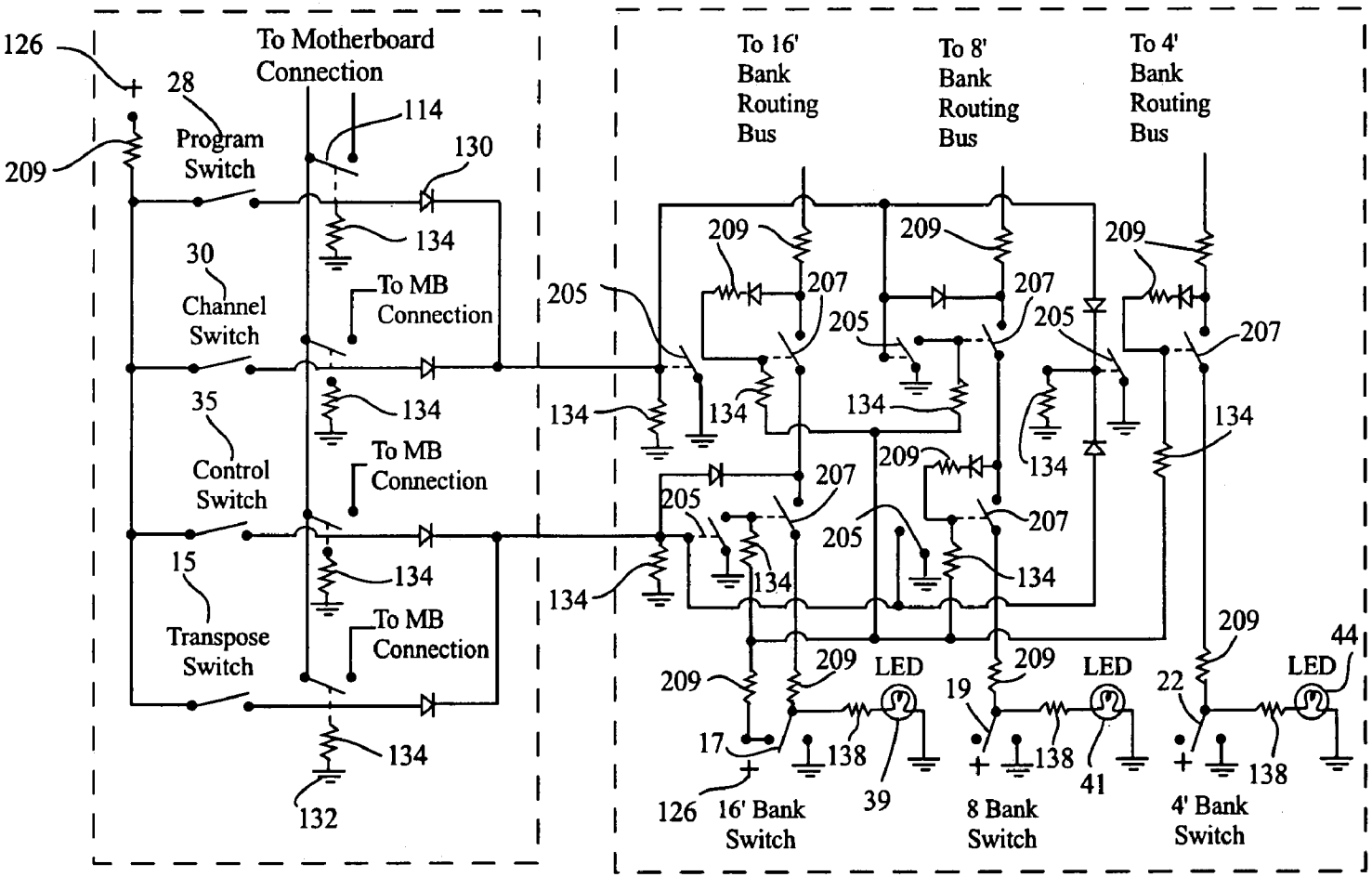
FIG. 8 is a circuit diagram illustrating the electrical wiring for the program switch, channel switch, control switch, and transpose switch.

FIG. 8 illustrates the wiring for the program switch 28, channel switch 30, control switch 35, and transpose switch 15 in a presently preferred embodiment. These function switches are used to accomplish two objectives: (1) They complete the circuit on the motherboard that the original motherboard function (program, channel, control and transpose) switches normally complete. This is accomplished in the left portion of FIG. 8. (2) Because the motherboard of the presently preferred embodiment originated from a 61 note keyboard controller and the range of these functions collectively spanned more than 32 notes, however individually each function could be accomplished within two different 32 note spans, it was necessary to devise circuitry to select the 16' bank and deselect the 8' and 4' bank, or select the 8' bank and deselect the 16' and 4' bank. This would also need to be done independently of the 16' bank switch 17, the 8' bank switch 19, and the 4' bank switch 22. This is accomplished with the circuitry on the right portion of FIG. 8.

The first objective is accomplished when one of the normally open function switches closes and connects the positive voltage via a 2K ohm resistor 209 to the control voltage terminal of a bilateral switch 114. This bilateral switch 114 was previously an open switch due to the negative biasing of the control voltage terminal though a 100K ohm resistor 134 connected to ground 132. This bilateral switch 114 now closes, completing the circuit at the motherboard for its particular function.

The second objective is accomplished in substantially the same manner for all functions (program, channel, control and transpose). When a function switch closes, positive voltage is transferred through a diode to the control voltage terminal of a first bilateral switch 205 and closes that bilateral switch. This first bilateral switch 205 was previously an open switch due to the negative biasing of the control voltage terminal through a 100K ohm resistor 134 connected to ground 132. This first closed bilateral switch 205 now connects ground 132 to the control voltage terminal of a second bilateral switch 207 that was previously closed (due to a positive biasing of its control voltage terminal through a 100K ohm resistor 134) and opens it. As a result the 16' bank switch 17, 8' bank switch 19, or 4' bank switch 22 is disconnected from the bank routing bus so that they have no effect on the bank routing bus polarity. What happens from this point depends if this particular bank is to be selected (positive to the bank routing bus) or deselected (negative to the bank routing bus). If the bank is to be selected, positive will be connected via a diode from the control voltage terminal of the first bilateral switch 205 and a 2K ohm resistor 209 (and for the 16' and 8' bank routing bus circuits employing the control and transpose functions through another normally closed second bilateral switch 207) to the bank routing bus. If the bank is to be deselected, negative will be connected via a diode and two 2K ohm resistors 209 from the control voltage terminal of the first bilateral switch 205 (and for the 16' and 8' bank routing bus circuits employing the control and transpose functions through another normally closed second bilateral switch 207) to the bank routing bus. In all cases when activating a function switch the 4' bank will be deselected causing its routing bus to have a negative (or grounded) polarity.

The bank switches are single pole, double throw switches that switch between ground 132 and positive 126. When the 16' bank switch 17, 8' bank switch 19, or 4' bank switch 22 is switched to ground 132, there is no current path through the 680 ohm resistor 138 or the 16' bank switch LED 39, 8' bank switch LED 41, or 4' bank switch LED 44, and the LED does not light. If none of the function (program, channel, control and transpose) switches are activated, the ground connection will be maintained through the normally closed second bilateral switches 207 to the respective routing bus. When the 16' bank switch 17, 8' bank switch 19, or 4' bank switch 22 is switched to positive, there is a current path through its corresponding 680 ohm resistor 138 and the corresponding 16' bank switch LED 39, 8' bank switch LED 41, or 4' bank switch LED 44, and the LED lights. If none of the function (program, channel, control, transpose) switches are activated, the positive connection will be maintained through the normally closed second bilateral switches 207 to the respective routing bus.

For example, when the transpose switch 15 closes, it connects the positive voltage via a 2K ohm resistor 209 to the control voltage terminal of a bilateral switch 114. This bilateral switch 114 was previously an open switch due to the negative biasing of the control voltage terminal through a 100K ohm resistor 134 connected to ground 132. This bilateral switch 114 now closes completing the circuit at the motherboard for the transpose function. This first RCA 4066 bilateral switch 205 of the 16' bank routing bus circuit whose control voltage terminal is connected to the transpose switch 15 via a diode is closed. The second bilateral switch 207 that is connected to the 16' bank switch 17 by a 2K ohm resistor 209 now opens, disconnecting the 16' bank switch 17 from the bank routing bus circuit. A diode connects positive to the top terminal of this second bilateral switch 207 and this positive is connected up to the top of the circuit via another normally closed second bilateral switch 207 and a 2K ohm resistor 209. The 16' bank is now selected. In the 8' bank routing bus circuitry, after the transpose switch 15 introduces a positive polarity via a diode to the first RCA 4066 bilateral switch 205, this first bilateral switch 205 closes, connecting ground 132 to the control voltage terminal of a second bilateral switch 207. This second bilateral switch 207 now opens, disconnecting the 8' bank switch 19 from the bank routing bus circuit. A diode and 2K ohm resistor 209 connect negative/ground to the top terminal of this second bilateral switch 207 and this negative is connected up to the top of the circuit via another normally closed bilateral switch 207 and a 2K ohm resistor 209. The 8' bank is now deselected. In the 4' bank routing bus circuitry, after the transpose switch 15 introduces a positive polarity via a diode to the first RCA 4066 bilateral switch 205, this first bilateral switch 205 closes, connecting ground 132 to the control voltage terminal of a second bilateral switch 207. This second bilateral switch 207 now opens, disconnecting the 4' bank switch 22 from the bank routing bus circuit. A diode and 2K ohm resistor 209 connects negative (or ground) to the top of the circuit via another 2K ohm resistor 209. The 4' bank is now deselected. This same selection process occurs when the control switch 35 is activated. A similar process happens involving the upper portion of the schematic diagram in FIG. 8 when the channel switch 30 or program switch 28 are activated except that the 8' bank is selected and the 16' and 4' banks are deselected.

In view of the foregoing, it will be understood by those skilled in the art that the methods and apparatuses of the present invention can facilitate the composing and playing of electronic music. The above-described embodiments have been provided by way of example, and the present invention is not limited to these examples. Multiple variations and modification to the disclosed embodiments will occur, to the extent not mutually exclusive, to those skilled in the art upon consideration of the foregoing description. For example, resistors of different values and different switches may be used in place of the current resistors and switches used by the present invention. Such variations and modifications, however, fall well within the scope of the present invention as set forth in the following claims.

What is claimed is:

1. A MIDI controller pedalboard comprising:

a plurality of note pedals comprising at least first, second and third note pedals configured to initiate MIDI note data upon activation;

a transpose function and transpose function circuitry co-operated with one or more of the plurality of note pedals and configured to transpose a note range of one or more initiated MIDI note data initiated from the activation of one or more of the plurality of note pedals;

a plurality of bank switches comprising a first bank switch and a second bank switch, where the first note pedal generates a first note when the first bank switch is active, the first note pedal generates a second note an octave above the first note when the second bank switch is active, and each of the note pedals, including the first, second and third note pedals, is defined to generate one of a first plurality of different notes when selected while the first bank switch is active and to generate the same defined note upon successive selections while the first bank switch is active and the transpose function has not been altered prior to a successive selection;

a volume controller configured to control volume of notes generated upon activation of the one or more of the plurality of note pedals; and a first MIDI output jack co-operated with one or more of the plurality of note pedals and configured to communicate MIDI note data to the external MIDI capable device in response to an activation of the one or more of the plurality of note pedals.

2. The MIDI controller pedalboard of claim 1, wherein the plurality of note pedals comprises 32 note pedals and wherein the plurality of bank switches comprises a 16' bank switch, an 8' bank switch, and a 4' bank switch.

3. The MIDI controller pedalboard of claim 2, wherein the 32 note pedals are disposed in a concave radiating configuration.

4. The MIDI controller pedalboard of claim 2, wherein the 32 note pedals are velocity sensitive.

5. The MIDI controller pedalboard of claim 1, wherein the volume controller comprises a volume control pedal.

6. The MIDI controller pedalboard of claim 5, wherein the volume controller further comprises a minimum volume dial.

7. The MIDI controller pedalboard of claim 5, wherein the MIDI controller pedalboard further comprises a removable volume control pedal, that may be electrically disconnected from the MIDI controller pedalboard and electrically connected to a separate device.

8. The MIDI controller pedalboard of claim 1, wherein the pedalboard further comprises:

a velocity curve modification function and velocity curve modification function circuitry;

a program selection function and program selection function circuitry;

a MIDI channel selection function and MIDI channel selection function circuitry; and a control shoe function selection and control shoe function selection circuitry.

9. The MIDI controller pedal board of claim 8, wherein:

the transpose function circuitry comprises a transpose switch and related circuitry which may be used in conjunction with the 32 note pedals;

the velocity curve modification function circuitry comprises a velocity switch and related circuitry;

the program selection function circuitry comprises a program switch and related circuitry, which may be used in conjunction with the 32 note pedals;

the MIDI channel selection function circuitry comprises a channel switch and related circuitry, which may be used in conjunction with the 32 note pedals; and the control shoe function selection circuitry comprises a control switch and related circuitry, and a control swell shoe pedal and related circuitry that may be operated in conjunction with the 32 note pedals.

10. The MIDI controller pedalboard of claim 8, wherein the control shoe function selection comprises and may be switched between an aftertouch function, a pitch bend function, a modulation function, a volume function, and a left to right audio panning function, and wherein the default function is the modulation function.

11. The MIDI controller pedalboard of claim 1, wherein the pedalboard further comprises:

a pitch bend swell shoe pedal; and a removable sustain pedal.

12. The MIDI controller pedalboard of claim 11, wherein the removable sustain pedal is attached to the MIDI controller pedalboard by hook and loop material.

13. The MIDI controller pedalboard of claim 9 or 11, wherein the pitch bend swell shoe pedal is a spring loaded shoe that returns to the center position.

14. The MIDI controller pedalboard of claim 1, wherein the first MIDI output jack transmits a default velocity curve.

15. The MIDI controller pedalboard of claim 14, wherein the MIDI controller pedalboard further comprises a second MIDI output jack and a removable programmable velocity converter, and wherein the second MIDI output jack may transmit a default velocity curve, or may transmit a programmed velocity curve based on the removable programmable velocity converter.

16. The MIDI controller pedalboard of claim 1, wherein the plurality of bank switches further comprise a third bank switch, where the first note pedal when activated generates a third note when the third bank switch is active such that the third note is two octaves above the first note.

17. The MIDI controller pedalboard of claim 16, wherein the first, second and third bank switches are independent such that the first note, the second note and the third note are generated independently.

18. A MIDI controller pedalboard comprising:

a plurality of note pedals configured to initiate MIDI note;

a transpose function and transpose function circuitry co-operated with one or more of the plurality of note pedals and configured to transpose a note range of pedal notes;

a plurality of bank switches comprising a first bank switch and a second bank switch, where a first note pedal generates a single first note when the first bank switch is active, the first note pedal generates a single second note an octave above the fist note when the second bank switch is active, and the first note pedal substantially simultaneously generates the first note and the second note when both the first bank switch and the second bank switch are active;

a volume controller configured to control volume of notes generated upon activation of the one or more of the plurality of note pedals; and a first MIDI output jack co-operated with one or more of the plurality of note pedals and configured to communicate MIDI note data to an external MIDI capable device in response to an activation of the one or more of the plurality of note pedals.

19. A MIDI controller pedalboard comprising:

a plurality of note pedals configured to initiate MIDI note;

a plurality of bank switches comprising a first bank switch and a second bank switch, where the first bank switch further comprising a first array of switches and the second bank switch further comprising a second array of switches, such that a first note pedal generates a fist note when the first bank switch is active and generates a second note an octave integer multiple different from the first note when the second bank switch is active;

a volume controller configured to control volume of notes generated upon activation of the one or more of the plurality of note pedals; and a first MIDI output jack co-operated with one or more of the plurality of note pedals and configured to communicate MIDI note data to an external MIDI capable device in response to an activation of the one or more of the plurality of note pedals.

20. The MIDI controller pedalboard of claim 1, wherein each of the note pedals, including the first, second and third note pedals, is defined to generate one of a second plurality of notes that are an octave above the first plurality of notes when selected while the second bank switch is active and to generate the same defined notes upon successive selections when selected to generate the notes while the second bank switch is active.

* * * * *

UNITED STATES PATENT AND TRADEMARK OFFICE

CERTIFICATE OF CORRECTION

PATENT NO. : 7,005,571 B1
APPLICATION NO. : 10/269387
DATED : February 28, 2006
INVENTOR(S) : Groff It is certified that error appears in the above-identified patent and that said Letters Patent is hereby corrected as shown below:

Title Page

Under *Attorney, Agent, or Firm* – please change "Sinssheimer" to -- Sinsheimer--.

Signed and Sealed this

Fifteenth Day of August, 2006

JON W. DUDAS
*Director of the United States Patent and Trademark Office*